US006738565B2

(12) United States Patent
Choi

(10) Patent No.: US 6,738,565 B2
(45) Date of Patent: May 18, 2004

(54) HALOGEN LAMP COUPLING STRUCTURE FOR ELECTRIC HEATER

(75) Inventor: Gun-Young Choi, Incheon-shi (KR)

(73) Assignees: IC Tech Co., Ltd., Incheon-shi (KR); Key-Young Choi, Incheon-shi (KR)

( * ) Notice: Subject to any disclaimer, the term of this patent is extended or adjusted under 35 U.S.C. 154(b) by 0 days.

(21) Appl. No.: 10/179,226

(22) Filed: Jun. 26, 2002

(65) Prior Publication Data

US 2003/0002275 A1 Jan. 2, 2003

(30) Foreign Application Priority Data

Jun. 30, 2001 (KR) ..... 2001-19802

(51) Int. Cl.[7] ..... H05B 3/00
(52) U.S. Cl. ..... 392/426; 392/376; 313/318.07
(58) Field of Search ..... 392/426, 376; 313/318.01, 318.07, 318.09, 318.11, 318.12; 445/40; 339/144 R

(56) References Cited

U.S. PATENT DOCUMENTS 3,622,832 A * 11/1971 Schlessel ..... 313/318.01
4,013,335 A * 3/1977 Varkonyi et al. ..... 339/144 R
4,578,043 A * 3/1986 Teshima et al. ..... 445/40
4,623,958 A * 11/1986 Van der Linde et al. ... 362/267
4,769,574 A * 9/1988 Nagasawa et al. ..... 313/318.09
4,864,184 A * 9/1989 Fleming ..... 313/318.01
5,057,735 A * 10/1991 Zalar et al. ..... 313/318.11
5,313,135 A * 5/1994 Fletcher ..... 313/318.01
5,453,656 A * 9/1995 Ui ..... 313/318.12
6,188,836 B1 2/2001 Glucksman et al.
6,205,677 B1 3/2001 Yune
6,215,236 B1 * 4/2001 Gotoh et al. ..... 313/318.07
6,304,719 B1 * 10/2001 Mo ..... 392/376
6,597,091 B2 * 7/2003 Choi ..... 313/318.01
2002/0003952 A1 1/2002 Choi
2002/0118961 A1 8/2002 Choi

FOREIGN PATENT DOCUMENTS

EP 577 196 A 1/1994

* cited by examiner

*Primary Examiner*—John A. Jeffery
*Assistant Examiner*—Leonid M Fastovsky
(74) *Attorney, Agent, or Firm*—Smith Patent Office

(57) ABSTRACT

A halogen lamp coupling structure for an electric heater allowing a fitting plate of a halogen lamp to be fitted into and coupled with a lamp fixing recess of a base serving as an insulation block. The halogen lamp coupling structure comprises a strap coupling type of elastic fixing member having a fixing strap fixed to the halogen lamp to surround the halogen lamp and an auxiliary fixing strap supported by an inner wall of the lamp fixing recess of the base. The fixing strap and the auxiliary fixing strap are connected with each other in a vertical direction by a bent piece.

2 Claims, 8 Drawing Sheets

HALOGEN LAMP COUPLING STRUCTURE FOR ELECTRIC HEATER

BACKGROUND OF THE INVENTION

1. Field of the Invention

The present invention relates to a halogen lamp coupling structure for an electric heater in which a lamp terminal of a halogen lamp is directly fitted into and coupled with a base. More particularly, the present invention relates to a halogen lamp coupling structure for an electric heater, wherein an elastic fixing member of which an upper strap fixes the halogen lamp and a lower strap is fitted into and secured in a fixing recess of a base is connected with the halogen lamp so that the halogen lamp with the elastic fixing member connected therewith is fitted into and coupled with the fixing recess of the base.

2. Description of the Prior Art

Generally, there have been provided various kinds of heating appliances. Among them, electric heating appliances convert electric energy into thermal energy by means of resistors and perform heating by using heat generated as such. As for methods of radiating the heat, there have been provided a method of reflecting heat, which is generated from a heating element, by a reflector so that the heat is diffusively radiated forward, and a method of radiating the heat forward by using a blower.

One of the electric heating appliances using the blower can be constructed, by way of example, as shown in FIGS. 1 to 3. FIG. 1 is a sectional view showing a heat generating device for a conventional heater, FIG. 2 is an exploded perspective view showing a major portion of the heat generating device for the conventional heater, and FIG. 3 is an enlarged sectional view showing an essential portion of the heat generating device for the conventional heater. Referring to these figures, a cover plate body 1-1 is constructed by a generally hemispherical plate and provided with a ventilation hole 1-1*a* at the center thereof. An entire surface of the cover plate body 1-1 is formed with heat dissipating apertures 1-1*b* for dissipating heat generated inside of the cover plate body 1-1.

A safety cover 1-2 is coupled with a front peripheral portion of the cover plate body 1-1 for preventing inflammables or an adjacent human body from coming into contact with halogen heating lamps 1-8 to be described later.

A reflecting mirror 1-3 is installed in front of an inner surface of the cover plate body 1-1 for forward reflecting light and heat which are emitted from the halogen heating lamps 1-8.

The reflecting mirror 1-3 is composed of a hemispherical plate by depositing aluminum having superior reflectability onto an inner surface of the hemispherical plate. The reflecting mirror 1-3 is formed with ventilation holes 1-3*a* at a central portion thereof. Further, an inclined surface 1-3*b* is formed at an outer periphery adjacent to the ventilation holes 1-3*a*. The reflecting mirror 1-3 is disposed in front of and fixed to the cover plate body 1-1 with a predetermined gap therebetween by using fasteners 1-3*c*.

A rear cap 1-4 having a plurality of heat dissipating apertures 1-4*a* is connected with a rear central portion of the cover plate body 1-1.

A blower fan 1-5 driven by a driving motor 1-5*a* is installed in the rear cap 1-4 so that it cause air to blow toward the ventilation hole 1-1*a* of the cover plate body 1-1.

An air guide plate 1-6 is disposed in front of the ventilation holes 1-3*a* of the reflecting mirror 1-3 for forward guiding the air, which has passed through the ventilation holes 1-1*a*, 1-3*a* of the cover plate body 1-1 and the reflecting mirror 1-3, along an inner surface of the reflecting mirror 1-3.

The air guide plate 1-6 is in the form of a disk with a protruding plate portion 1-6*a* formed at the rear thereof and with a forward-flared guide wing portion 1-6*b* at a front outer periphery thereof. The protruding plate portion 1-6*a* is fixed to a central inner surface of the reflecting mirror 1-3 by spot welding.

With the structure of the air guide plate 1-6 constructed as such, an air passage AT is formed between the air guide plate 1-6 and the ventilation holes 1-3*a* of the reflecting mirror 1-3. The air blown by the blower fan 1-5 is guided forward through the air passage AT and along the inner surface of the reflecting mirror 1-3.

An insulation block 1-7 is fixed to a front surface of the air guide plate 1-6 by a fastener 1-7*a*.

The insulation block 1-7 is provided with two pairs of connection terminals 1-7*b* therein so that connection pins of the halogen heating lamps which will be introduced from the front of the terminals can be connected with the respective terminals. A front face of the insulation block 1-7 is formed with a pair of lamp coupling grooves 1-7*c*. Further, electric wires are connected with the connection terminals 1-7*b* for supplying electricity thereto.

The pair of halogen heating lamps 1-8 are coupled with the insulation block 1-7.

Each of the halogen heating lamps 1-8 comprises a heating lamp body 1-81 for generating heat, and a holding block 1-82 for holding trailing ends of the heating lamp body 1-81. At this time, the heating lamp body 1-81 is constructed such that a heating body 1-81*b* made of tungsten is installed in a U-shaped quartz tube member 1-81*a* filled with halogen and the heating body 1-81*b* is connected with the connection pins 1-81*c* which are exposed from trailing ends of the tube member 1-81*a*. The holding block 1-82 is molded with ceramic to enclose and connect the both trailing ends of the tube member 1-81*a*.

The holding of the trailing ends of the tube member 1-81*a* by means of the holding block 1-82 prevents the quartz tube member 1-81*a* from being broken by external force upon handling of the halogen heating lamp 1-8.

The holding block 1-82 of the halogen heating lamp 1-8 is fitted into and coupled with the relevant lamp coupling groove 1-7*c* of the insulation block 1-7, and the connection pin 1-81*c* is inserted into and coupled with the relevant connection terminal 17*b*.

The reason why the halogen heating lamp 1-8 detachably coupled with the insulation block 1-7 is employed in the prior art for generating the heat is that the halogen heating lamp 1-8 which has been completely used up can be easily replaced and superior heating effects can be obtained.

A hollow tubular stay 1-9 is disposed at a front central portion of the insulation block between the holding blocks 1-82 of the halogen heating lamps 1-8. A reflector 1-10 for reflecting the heat and light generated from the halogen heating lamps 1-8 onto the inner surface of the reflecting mirror 1-3 is firmly attached to a leading end of the stay 1-9. The stay 1-9 and the reflector 1-10 are coupled with each other by using a fastening bolt 1-11 axially passing through the interior of the stay 1-9 and a nut 1-11*a* screwed over a leading end of the fastening bolt 1-11 which has passed through the holding block 1-82 and a cover plate 1-7*d* of the insulation block 1-7.

In this case, the heating lamp body 1-81 is fitted into and bonded with the holding block 1-82 by using an adhesive or the like. Then, the holding block is coupled and assembled with the lamp coupling groove 1-7*c* of the insulation block 1-7. Therefore, there is convenience of assembly thereof. However, since the both ends of the heating lamp body 1-81 are bonded with the holding block 1-82, there is a problem in that the both ends of the heating lamp body 1-81 may be easily broken when being subjected to impact.

Meanwhile, a specific example of a conventional electric heater using reflected heat by means of a reflector is shown in FIGS. 4 to 6. FIG. 4 is an exploded perspective view showing a coupling structure of a conventional halogen heater tube, FIG. 5 is a sectional view taken along line C—C of FIG. 4 in a state where all components of FIG. 4 are coupled with one another, and FIG. 6 is a sectional view taken along line D—D of FIG. 4 in the coupled state. In a halogen lamp fixing device for the conventional electric heater, a fitting plate 2 of a halogen lamp 1 is fitted into and fixed in a lamp fixing recess 50 of a base 6. The halogen lamp fixing device comprises an elastic fixing member 10 having fixing straps 20, 30 for fixing the halogen lamp 1. The lamp fixing recess 50 has a size capable of simultaneously accommodating the fitting plate 2 of the halogen lamp 1 and the elastic fixing member 10 therein and is formed at a fixing position of the halogen lamp in the base 6. A bottom surface of the fixing recess 50 is formed with fixing lever slits 51. Reference numeral 1-1 designates an insulation fabric for performing an insulation function when the halogen lamp 1 is coupled with the elastic fixing member 10; 3 is a lamp terminal; 21 is a fitting boss inserted into a fitting hole 22; 40 is a bent piece for connecting the fixing strap 20 and the auxiliary fixing strap 30; 31 are fixing levers; 32 are fixing pieces; and 5-2 is a hole for an electric wire.

According to the above constitution, as shown in FIG. 4, the base 6 is formed with the fixing recess 50 having a diameter corresponding to that of the coupled halogen lamp 1 and the elastic fixing member 10, and the halogen lamp 1 is coupled with the elastic fixing member around the insulation fabric 1-1 of the halogen lamp 1 by inserting the fitting boss 21 of the fixing strap 20 into the fitting hole 22 thereof. The fixing levers 31 of the elastic fixing member coupled with the halogen lamp are fitted into the fixing lever slits 51 formed in the bottom surface of the fixing recess 50 and then fixed to the base 6 by bending the fixing pieces 32 exposed beyond the bottom surface of the base 6, as shown in FIG. 6. Of course, a separate electric wire (not shown) is connected to the lamp terminal 3.

However, since the halogen lamp 1 is coupled with the elastic fixing member 10, the fixing levers 31 of the elastic fixing member 10 are fitted into the fixing lever slits 51 and fixed to the base, and the lamp terminal 3 simultaneously penetrates through the base 6 and is additionally connected to the separate connection electric wire (not shown), there are problems in that workability is lowered and considerable time and skill are required for repair of the halogen lamp 1 upon breakage thereof, thereby increasing repair costs.

SUMMARY OF THE INVENTION

The present invention is conceived to solve the problem. An object of the present invention is to provide a halogen lamp coupling structure by which the life of a halogen lamp can be prolonged and the maintenance of the halogen lamp can be facilitated.

To this end, the present invention is directed to a halogen lamp coupling structure in which a lamp terminal of a halogen lamp is directly fitted into and coupled with a base. More particularly, the present invention is directed to a halogen lamp coupling structure, wherein an elastic fixing member of which an upper strap fixes the halogen lamp and a lower strap is fitted into and secured in a fixing recess of a base is connected with the halogen lamp so that the halogen lamp with the elastic fixing member connected therewith is fitted into and coupled with the fixing recess of the base.

That is, according to one aspect of the present invention, there is provided a halogen lamp coupling structure for an electric heater for allowing a fitting plate of a halogen lamp to be fitted into and coupled with a lamp fixing recess of a base serving as an insulation block. The halogen lamp coupling structure comprises a strap coupling type of elastic fixing member having a fixing strap fixed to the halogen lamp to surround the halogen lamp and an auxiliary fixing strap supported by an inner wall of the lamp fixing recess of the base. The fixing strap and the auxiliary fixing strap are connected with each other in a vertical direction by a bent piece. The base serving as the insulation block is formed with the lamp fixing recess which takes the shape of an elliptical recess and accommodates the elastic fixing member therein and of which the bottom is provided with a fitting contact member for causing a lamp terminal of the halogen lamp to be fitted into an elongated hole.

The fitting contact member may include a cover plate which defines a bottom surface of the elliptical fixing recess and has the elongated hole corresponding to the lamp terminal, and a connection terminal which is installed in a bottom groove below the cover plate, is in contact with the lamp terminal fitted through the elongated hole by means of elastic force of a spring and is connected to an electric wire.

According to another aspect of the present invention, there is provided a halogen lamp coupling structure for an electric heater for allowing a fitting plate of a halogen lamp to be fitted into and coupled with a lamp fixing recess of a base serving as an insulation block. The halogen lamp coupling structure comprises an elastic fixing member including a receiving bore having a depth capable of accommodating the fitting plate and a portion of a body of the halogen lamp, and an insertion hole formed in a bottom surface of the elastic fixing member so that a lamp terminal of the halogen lamp can penetrate through the insertion hole. The base serving as the insulation block is formed with the lamp fixing recess which takes the shape of an elliptical recess and accommodates the above elastic fixing member therein and of which the bottom is provided with a fitting contact member for causing the lamp terminal of the halogen lamp to be fitted into an elongated hole.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described in detail with reference to the accompanying drawings.

Figure 1:
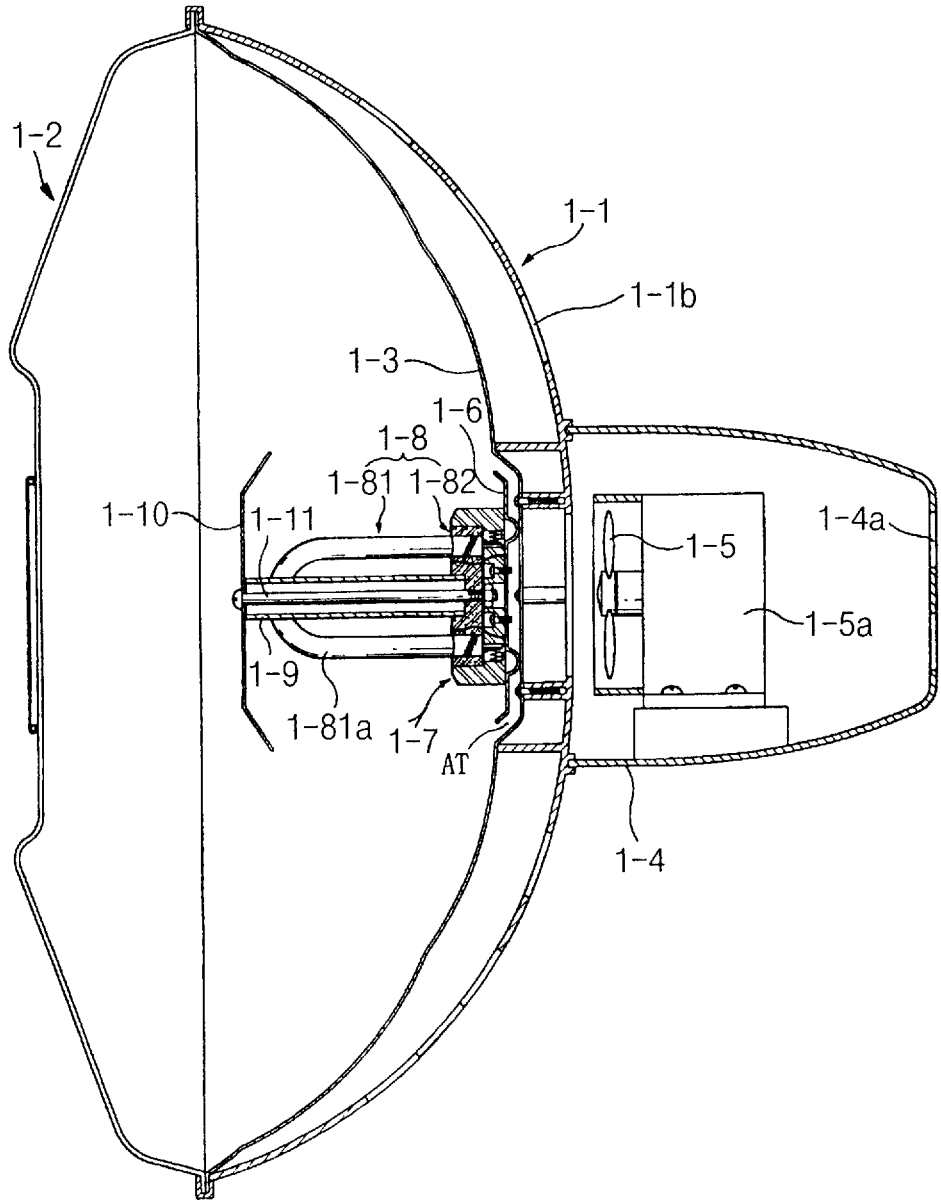
FIG. 1 is a sectional view of a conventional air heater.
Figure 2:
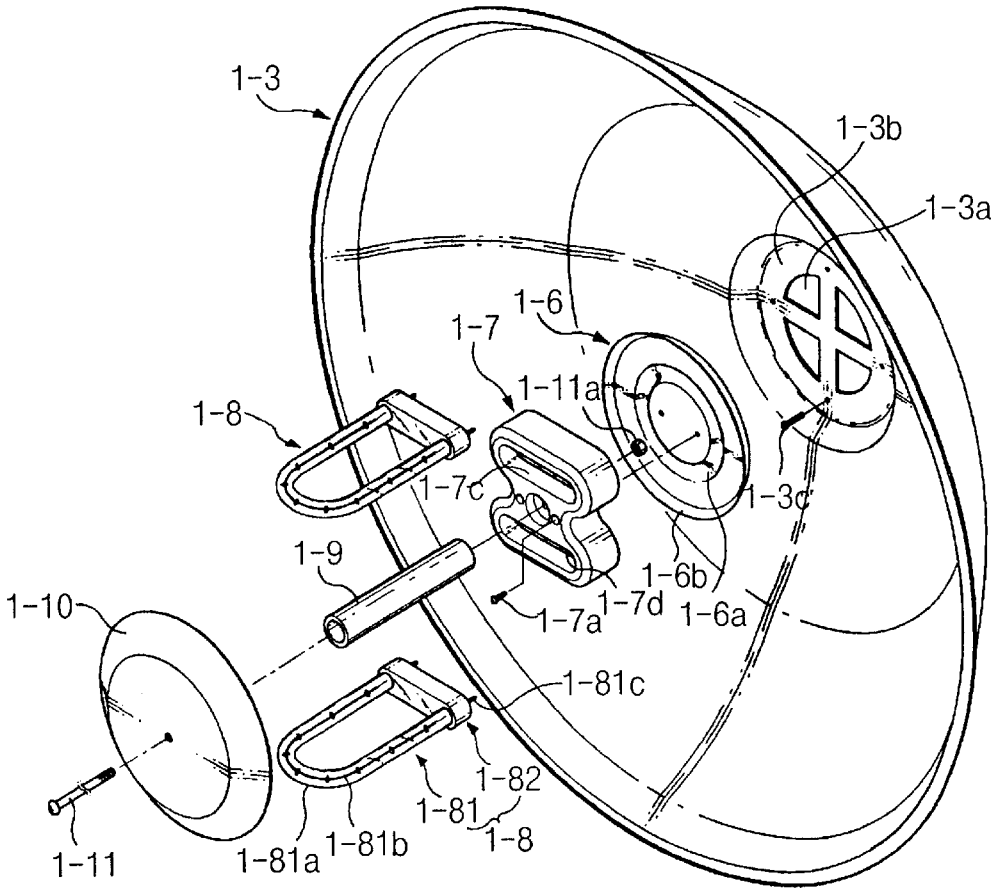
FIG. 2 is an exploded perspective view of a major portion of FIG. 1.
Figure 3:
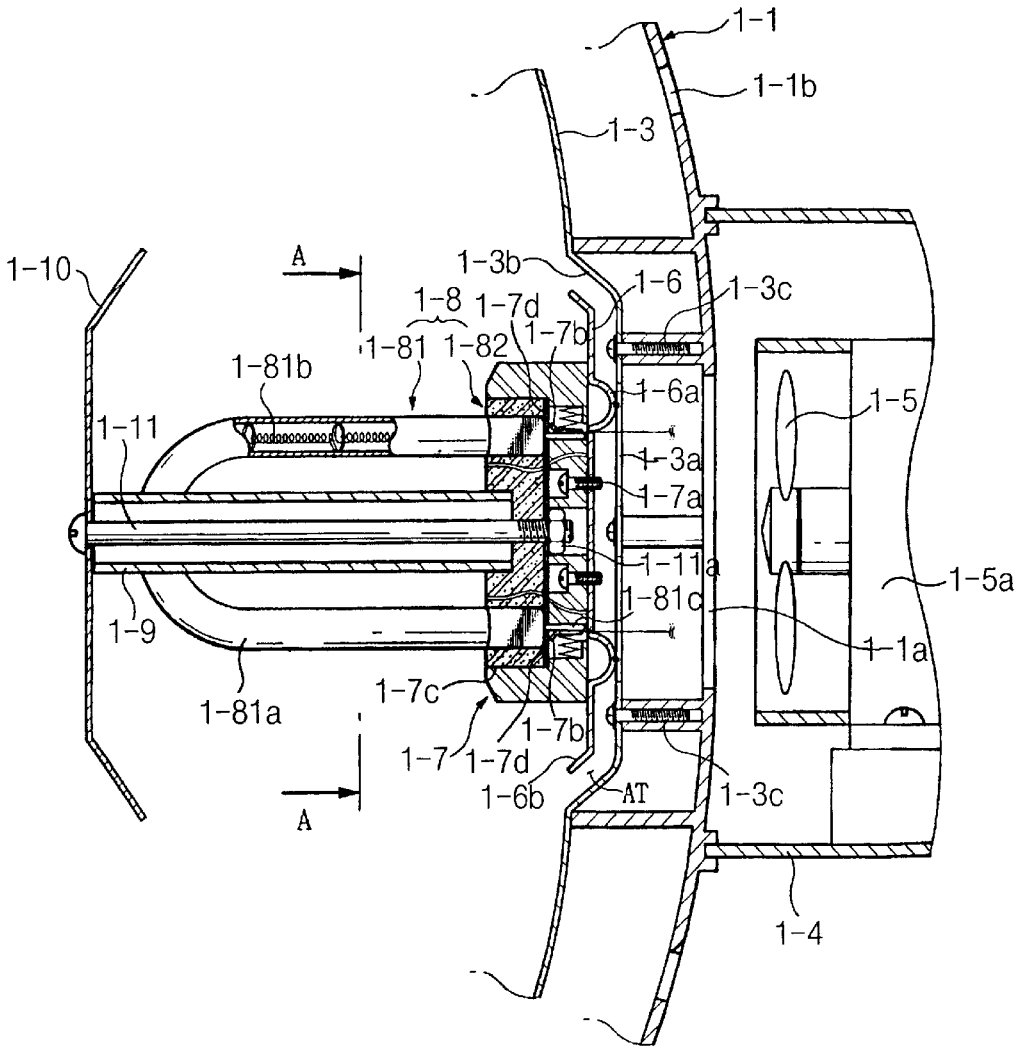
FIG. 3 is an enlarged sectional view of an essential portion of FIG. 1.
Figure 4:
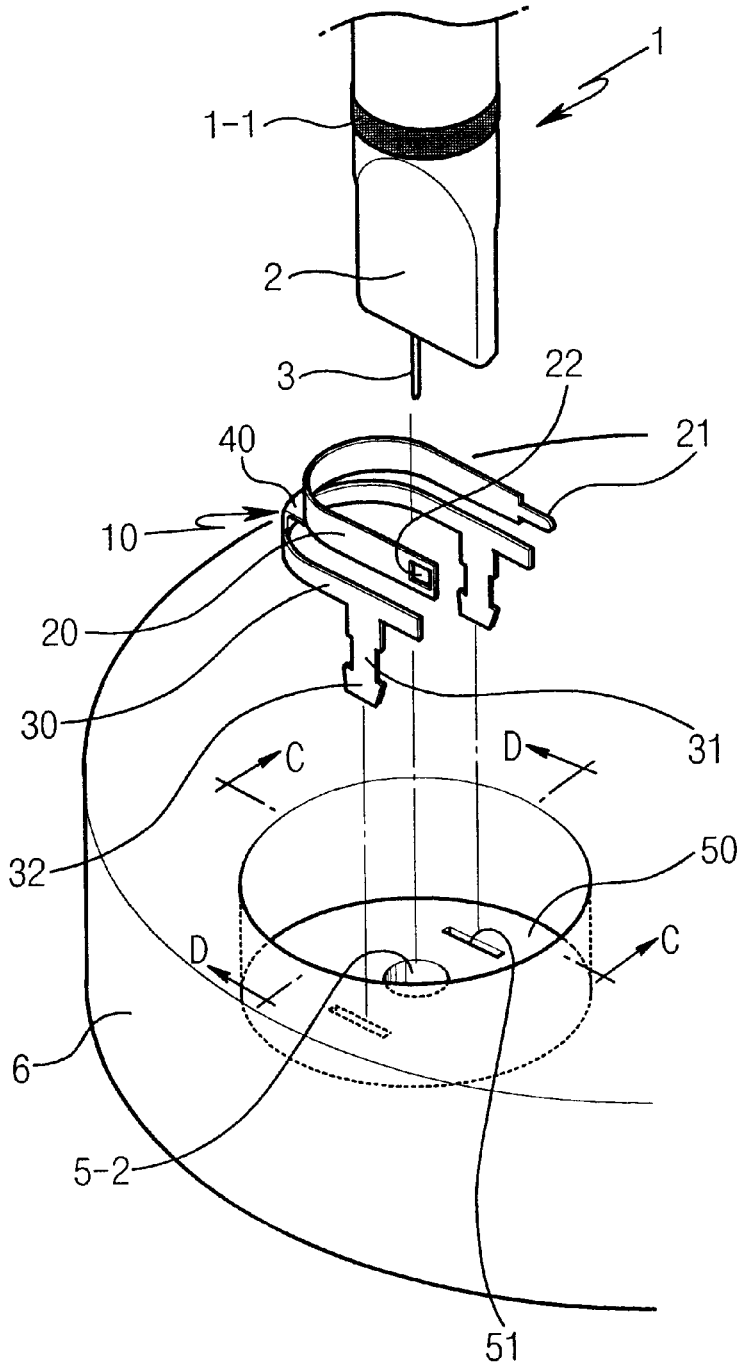
FIG. 4 is an exploded perspective view of a coupling structure for a conventional halogen heater tube.
Figure 5:
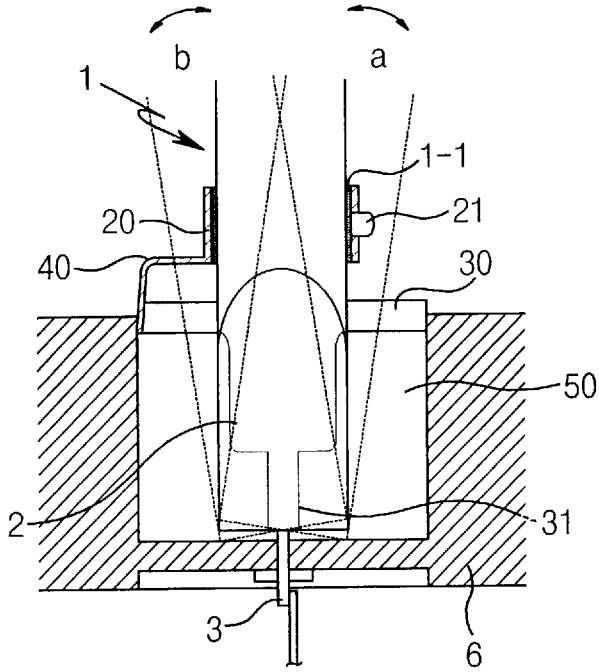
FIG. 5 is an enlarged sectional view taken along line C—C of FIG. 4.
Figure 6:
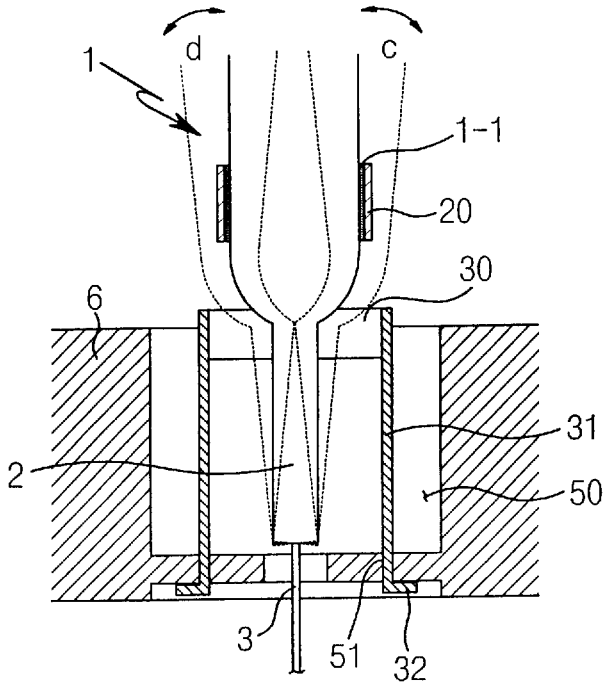
FIG. 6 is an enlarged sectional view taken along line D—D of FIG. 4.
Figure 7:
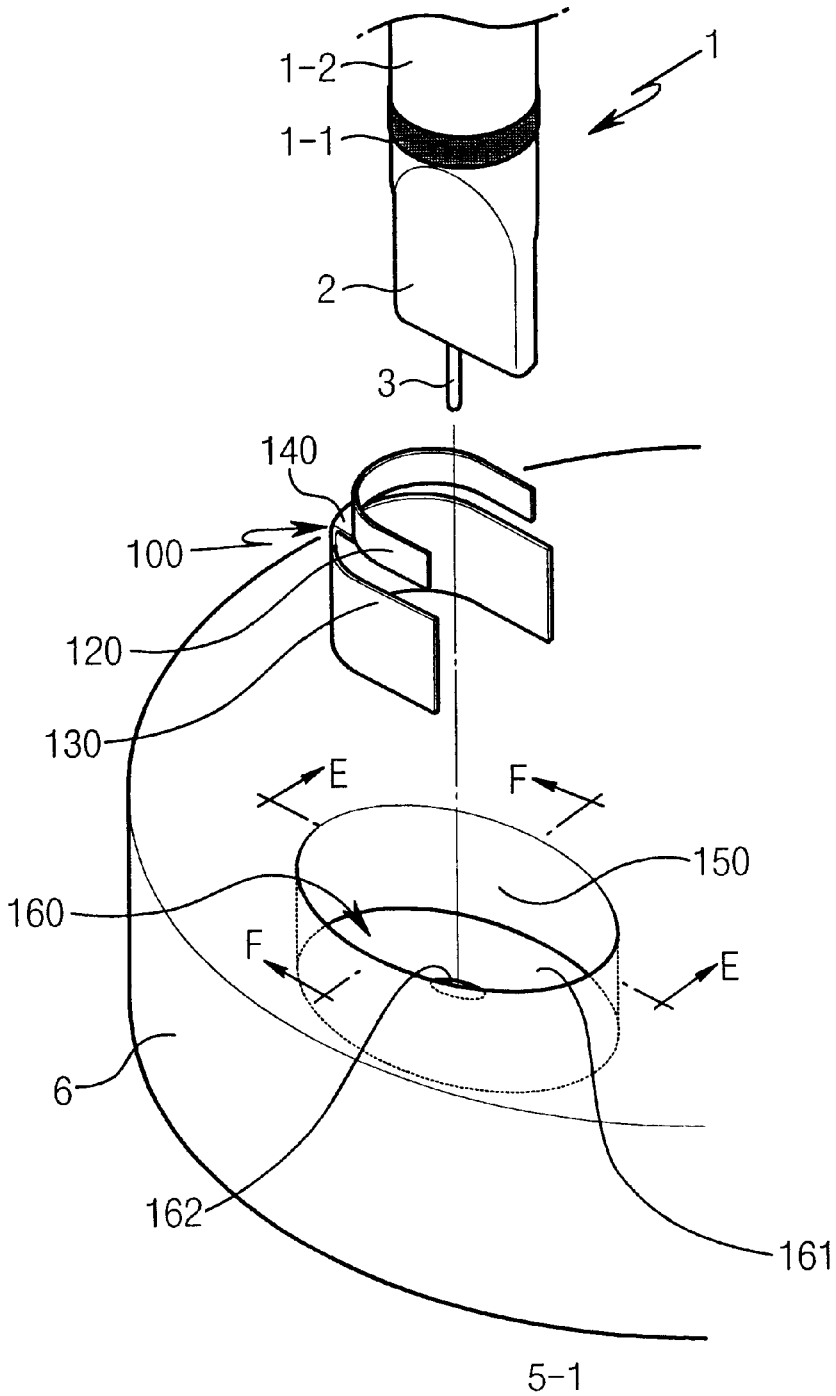
FIG. 7 is an exploded perspective view of a halogen lamp coupling structure according to one example of the present invention.
Figure 8:
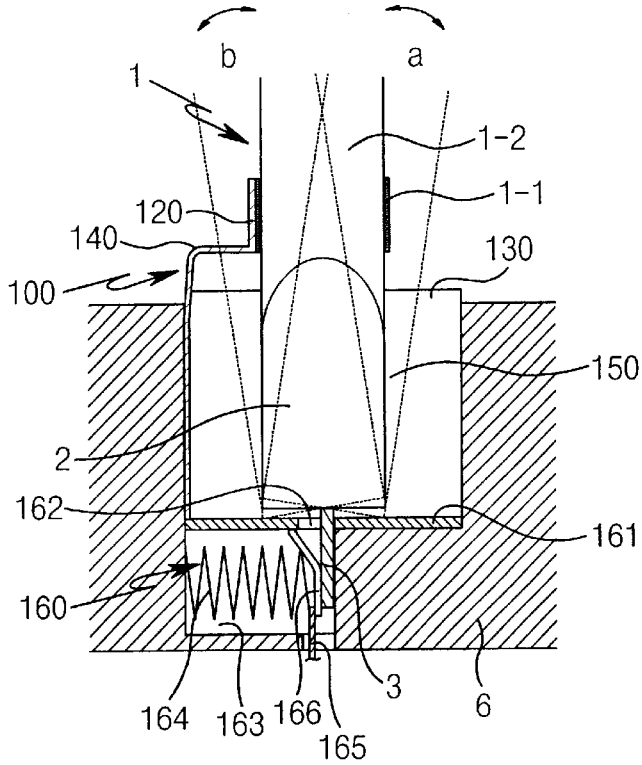
FIG. 8 is an enlarged sectional view taken along line E—E of FIG. 7.
Figure 9:
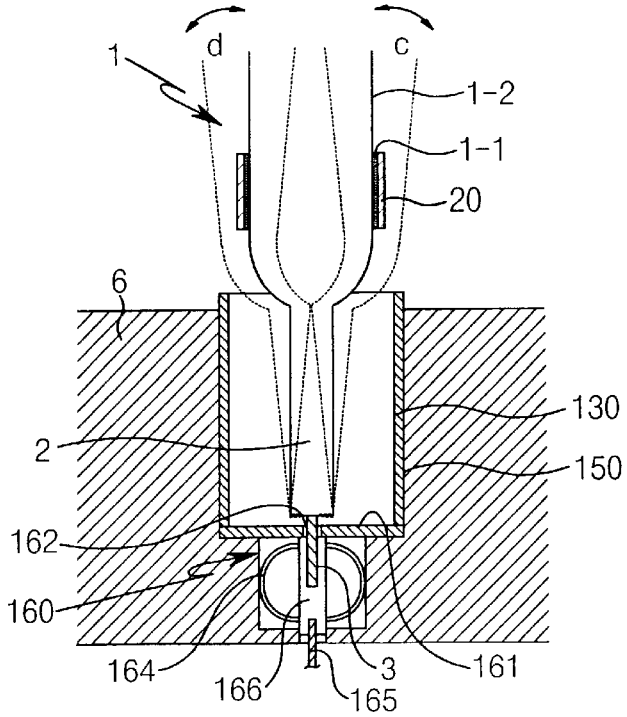
FIG. 9 is an enlarged sectional view taken along line F—F of FIG. 7.

FIG. 7 is an exploded perspective view of a halogen lamp coupling structure according to one example of the present invention, FIG. 8 is an enlarged sectional view taken along line E—E of FIG. 7, and FIG. 9 is an enlarged sectional view taken along line F—F of FIG. 7. In the figures, like reference numerals are used for elements similar to those of the conventional halogen lamp coupling structure.

The halogen lamp coupling structure for an electric heater allows a fitting plate 2 of a halogen lamp 1 to be fitted into and coupled with a lamp fixing recess 150 of a base 6 serving as an insulation block.

The halogen lamp coupling structure comprises a strap coupling type of elastic fixing member 100 having a fixing strap 120 fixed to the halogen lamp 1 to surround the halogen lamp 1 and an auxiliary fixing strap 130 supported by an inner wall of the lamp fixing recess 150 of the base 6. The fixing strap 120 and the auxiliary fixing strap 130 are connected with each other in a vertical direction by a bent piece 140.

The base 6 serving as the insulation block is formed with the lamp fixing recess 150 which takes the shape of an elliptical recess and accommodates the elastic fixing member 100 therein and of which the bottom is provided with a fitting contact member 160 for causing a lamp terminal 3 of the halogen lamp 1 to be fitted into an elongated hole 162.

The fitting contact member 160 includes a cover plate 161 which defines a bottom surface of the elliptical fixing recess 150 and has the elongated hole 162 formed at a position corresponding to the lamp terminal 3 for guiding the fitting coupling of the lamp terminal therein, and a connection terminal 166 which is installed in a bottom groove 163 below the cover plate 161, is in contact with the lamp terminal 3 fitted through the elongated hole 162 by means of elastic force of a spring 164 and is connected to an electric wire 165.

Figure 10:
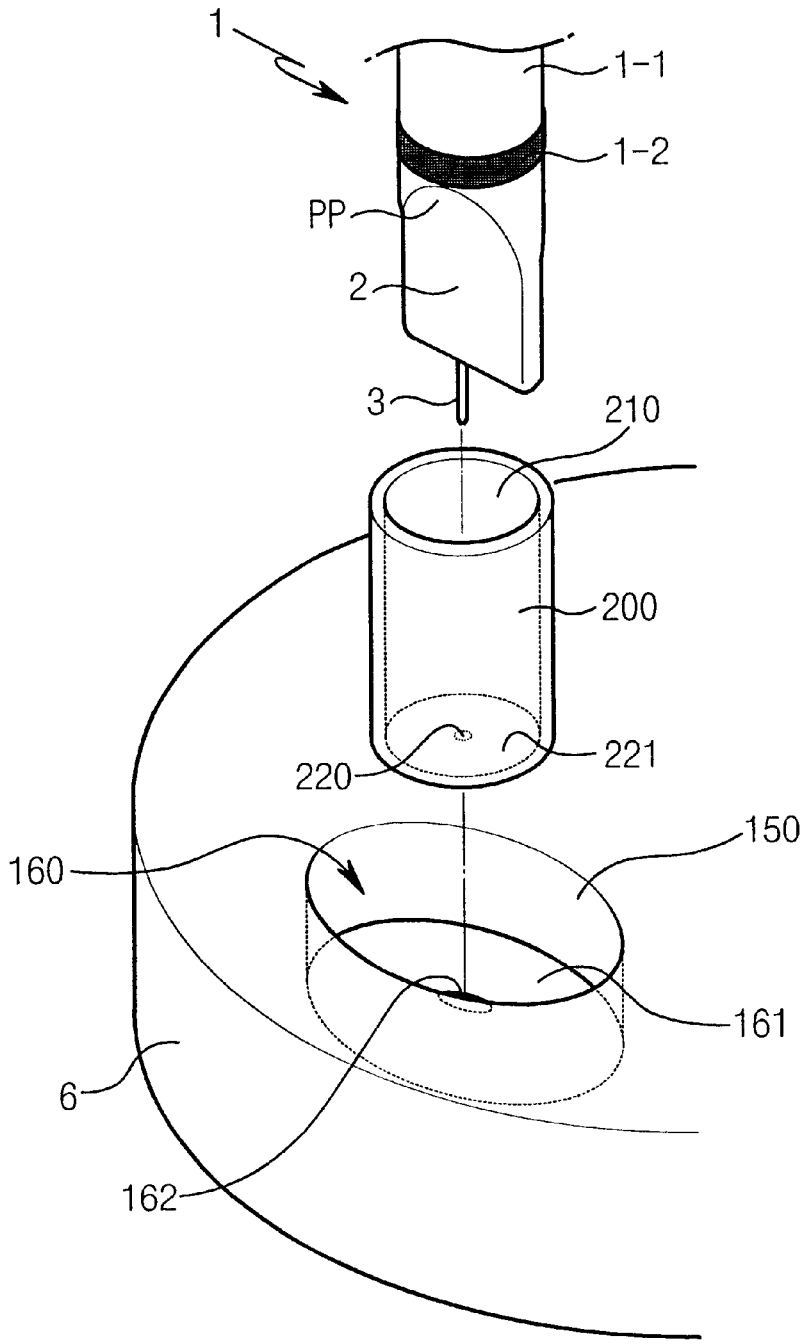
FIG. 10 is an exploded perspective view of a halogen lamp coupling structure according to another example of the present invention.

FIG. 10 shows a halogen lamp coupling structure according to another example of the present invention, similar to FIG. 7. The halogen lamp coupling structure for an electric heater also allows a fitting plate 2 of a halogen lamp 1 to be fitted into and coupled with a lamp fixing recess 150 of a base 6 serving as an insulation block.

The halogen lamp coupling structure comprises an elastic fixing member 200 including a receiving bore 210 having a depth capable of accommodating the fitting plate 2 and a portion of a body 1-2 of the halogen lamp 1, and an insertion hole 220 formed in a bottom surface of the elastic fixing member so that a lamp terminal 3 of the halogen lamp can penetrate through the insertion hole.

The base 6 serving as the insulation block is formed with the lamp fixing recess 150 which takes the shape of an elliptical recess and accommodates the elastic fixing member 200 therein and of which the bottom is provided with a fitting contact member 160 for causing the lamp terminal 3 of the halogen lamp 1 to be fitted into an elongated hole 162. Reference numeral 161 designates the cover plate for covering the fitting contact member 160. Since the constitution of the fitting contact member 160 is identical to that shown in FIGS. 7 and 9, the description thereof will be omitted.

According to the present invention constructed as such, since the lamp terminals 3 formed at the both ends of the U-shaped halogen lamp 1 are simply fitted into and coupled with the fixing recess 150 of the base 6, there are advantages in that their assembly can be easily made and impact resistance of the lamp can be enhanced. To this end, the fitting plate 2 of the halogen lamp 1 and a portion of the body 1-2 of the lamp adjacent the fitting plate are surrounded by and coupled with the fixing strap 120 upon assembly thereof. In this state, the auxiliary fixing strap 130 shown in FIG. 7 is seated in the fixing recess 150 and the lamp terminal 3 is simultaneously fitted into and penetrates through the elongated hole 162 of the cover plate 161 disposed at the bottom of the fixing recess.

That is, easy coupling also means easy disassembly. Therefore, if the lamp 1 is broken in the future, the lamp assembly of the lamp and the elastic fixing member 100 coupled therewith can be wholly replaced with a new one. Accordingly, it is not necessary to separately disassemble the entire lamp assembly for the replacement thereof.

Further, since the fixing recess 150 is formed as an elliptical recess, the lamp terminal 3 can be conveniently fitted into the elongated hole 162. That is, the lamp terminal is simply required to be fitted into the elongated hole 162, so that their assemblability can be improved.

The elastic fixing member 100 of the halogen lamp coupling structure according to the present invention does not perform only the fixation of the lamp. As shown in FIGS. 8 and 9, the fixing strap 120 fixes the lamp 1 and the auxiliary fixing strap 130 is secured in the fixing recess 150. Since both the straps 120, 130 are connected to each other by the bent piece 140, elastic movement therebetween can be made owing to the bent piece 140. Thus, the fixing strap 120 and the lamp 1 can move in response to external impact or vibration. Consequently, the impact resistance thereof can be enhanced. That is, according to the present invention, the fitting coupling can be facilitated and the impact resistance can be improved. In this case, if the auxiliary fixing strap 130 is constructed to have a height equal to the depth of the fixing recess 150, the elastic fixing member 100 functions to press down the cover plate 161. Therefore, it is not necessary to employ an additional means for attaching the cover plate 161 to the base 6, e.g. riveting. As a result, the number of manufacturing processes and production costs can be reduced.

Furthermore, the halogen lamp coupling structure of the present invention can be constructed as shown in FIG. 10. In such a case, the fitting plate 2 and a portion of the body 1-2 of the halogen lamp 1 are fitted into the receiving bore 210 of the elastic fixing member 200 and the lamp terminal 3 is fitted into the insertion hole 220 formed in the bottom surface 221 of the elastic fixing member 200. If necessary, a heat resistant adhesive (not shown) may be applied thereto so as to maintain the coupling therebetween. Then, the elastic fixing member 200 and the halogen lamp 1 are fitted into the elliptical fixing recess 150 at a time. At this time, the lamp terminal 3 of the halogen lamp 1 is fitted into and penetrates through the elongated hole 162 of the cover plate 161. Since the halogen lamp 1 is primarily assembled in a state where even the portion of the body 1-2 of the halogen lamp 1 is fitted into and coupled with the elastic fixing member 200, an interface pp between the fitting plate 2 and the body 1-2 is not exposed to the outside. Thus, even when subjected to impact, the interface pp is prevented from being broken. Furthermore, as shown in FIGS. 8 and 9, since the elastic fixing member 200 having the circular bottom surface 221 is used, some degree of play thereof can be allowed in the elliptical fixing recess 150, thereby having high flexibility and impact resistance. Of course, to this end, a minor diameter of the ellipse should be larger than the diameter of the elastic fixing member 200.

The elastic fixing member 200 is primarily coupled with each of both the ends of the halogen lamp 1 and then simply fitted into the fixing recess 150. Thus, the assemblability of the lamp and the base can be greatly enhanced. Upon replacement of the halogen lamp 1, only the broken halogen lamp 1 (elastic fixing member 200) is disassembled from the fixing recess 150 and then a new halogen lamp 1 (elastic fixing lamp 200) is fitted and assembled into the fixing recess 150. At this time, the lamp terminal 3 penetrates through the elongated hole 162 of the cover plate 161 and comes into contact with the fitting contact member 160 so that the lamp terminal 3 is supplied with electric power. Thus, since even an ordinary person as well as the skilled can perform the replacement or maintenance of the halogen lamp, after-sale service costs can be reduced.

According to the present invention, since the strap coupling type of elastic fixing member of which the upper strap fixes the halogen lamp and the lower auxiliary strap is fitted into and secured in the fixing recess is utilized, the halogen lamp and the elastic fixing member can be coupled with the fixing recess of the base at a time with only the fitting operation. Accordingly, upon even replacement of the lamp, everyone can easily perform the replacement of the lamp.

Alternatively, when the tubular elastic fixing member with the closed bottom is utilized, the receiving bore of the tubular elastic fixing member is constructed to be deep so that the fitting plate and the portion of the body of the lamp can be fitted into the receiving bore. Thus, the breakage of the lamp resulting from damage to the interface between the fitting plate and the body of the lamp can be avoided. Further, since the diameter of the elastic fixing member is smaller than the minor diameter of the ellipse of the fixing recess, the high flexibility can be ensured and the lamp can move laterally with respect to the lamp terminal 3 when subjected to impact. Thus, the impact resistance can be enhanced.

Although the present invention has been described with respect to preferred embodiments shown in the drawings, the present invention is not limited thereto. It will be apparent to those skilled in the art that various substitutions, changes and modifications can be made thereto without departing from the technical spirit and scope of the invention.

What is claimed is:

1. A halogen lamp coupling structure for an electric heater for allowing a fitting plate of a halogen lamp to be fitted into and coupled with a lamp fixing recess of a base serving as an insulation block, comprising:

a strap coupling type of elastic fixing member having a fixing strap fixed to the halogen lamp to surround the halogen lamp and an auxiliary fixing strap supported by an inner wall of the lamp fixing recess of the base, said fixing strap and said auxiliary fixing strap being connected with each other in a vertical direction by a bent piece, wherein the base serving as the insulation block is formed with the lamp fixing recess which takes the shape of an elliptical recess and accommodates the elastic fixing member therein and of which the bottom is provided with a fitting contact member for causing a lamp terminal of the halogen lamp to be fitted into an elongated hole.

2. The halogen lamp coupling structure as claimed in claim 1, wherein the fitting contact member includes a cover plate which defines a bottom surface of the elliptical fixing recess and has the elongated hole formed at a position corresponding to the lamp terminal for guiding the fitting coupling of the lamp terminal therein, and a connection terminal which is installed in a bottom groove below the cover plate, is in contact with the lamp terminal fitted through the elongated hole by means of elastic force of a spring and is connected to an electric wire.

* * * * *